US005417357A

United States Patent [19]

Yquel

[11] Patent Number: 5,417,357

[45] Date of Patent: May 23, 1995

[54] VALVE FOR A PRESSURIZED CONTAINER

[75] Inventor: Jean-Pierre Yquel, Colombes, France

[73] Assignee: L'Oreal, Paris, France

[21] Appl. No.: 190,186

[22] PCT Filed: Jul. 22, 1992

[86] PCT No.: PCT/FR92/00717

§ 371 Date: Feb. 7, 1994

§ 102(e) Date: Feb. 7, 1994

[87] PCT Pub. No.: WO93/02948

PCT Pub. Date: Feb. 18, 1993

[30] Foreign Application Priority Data

Aug. 7, 1991 [FR] France ..... 91 10040

[51] Int. Cl.[6] ..... B65D 83/14

[52] U.S. Cl. ..... 222/402.24; 222/500; 222/402.18

[58] Field of Search ..... 222/500, 153, 402.1, 222/402.11, 402.18, 402.2, 402.24, 464

[56] References Cited

U.S. PATENT DOCUMENTS

| | | | |
|---|---|---|---|
| 3,372,845 | 3/1968 | Frangos | 222/500 X |
| 3,497,112 | 2/1970 | Samuelson | 222/402.18 X |
| 3,542,254 | 11/1970 | Samuelson et al. | 222/402.19 |
| 3,653,553 | 4/1972 | Prussin et al. | 222/402.18 X |
| 3,733,009 | 5/1973 | Rouzier et al. | 222/402.18 X |
| 3,741,446 | 6/1973 | Marand | 222/402.24 |
| 3,893,596 | 7/1975 | Beres et al. | 222/402.19 |
| 4,116,370 | 9/1978 | Spitzer et al. | 222/500 X |
| 4,117,958 | 10/1978 | Spitzer et al. | 222/402.18 |
| 4,475,667 | 10/1984 | Ori et al. | 222/464 X |
| 4,850,517 | 7/1989 | Ter Stege | 222/402.18 |
| 4,940,170 | 7/1990 | Popp-Ginsbach | 222/500 X |
| 4,940,171 | 7/1990 | Gilroy | 222/402.18 |
| 5,186,201 | 2/1993 | Warren | 222/500 |

FOREIGN PATENT DOCUMENTS

| | | | |
|---|---|---|---|
| 0325519 | 7/1989 | European Pat. Off. | 222/402.1 |
| 2237423 | 2/1975 | France . | |
| 2375111 | 7/1978 | France . | |
| 1955397 | 7/1970 | Germany . | |
| 384491 | 2/1965 | Switzerland . | |
| 2024335 | 1/1980 | United Kingdom | 222/402.18 |

*Primary Examiner*—Kevin P. Shaver
*Attorney, Agent, or Firm*—Young & Thompson

[57] ABSTRACT

A valve (6) including a valve body (7) intended to be fixed into a dished part (5) mounted on a can (1), a valve stem (12) which can move axially in the valve body, and elastic return device (18) for returning the valve stem to a closed position. The valve (6) is combined with a clack valve (C) which is sensitive to the action of gravity and capable of closing the outlet of the valve (6) when the container occupies a position which is away from its normal position of use. A micro-orifice (F) is provided in the wall of the valve body (7) in order to establish a communication between the pressurized internal volume of the container (1) and the zone of the valve (6) situated downstream of the shut off member (21) of the clack valve (C) in the closed position, in order to balance out the pressures on either side of this shut off member (21).

9 Claims, 4 Drawing Sheets

VALVE FOR A PRESSURIZED CONTAINER

FIELD OF THE INVENTION

The invention relates to a valve for a pressurized container or aerosol can, of the sort of those which comprise a valve body intended to be fixed into a dished part mounted on the can, a valve stem which can move axially in the valve body, and elastic return means for returning the valve stem to a closed position, whereas opening of the valve is obtained by a driving-in action on the stem, said valve being combined with a clack valve which is sensitive to the action of gravity and capable of closing the outlet of the valve when the container occupies a position which is more than a predetermined limit away from its normal position of use.

In general the container is intended to be used either with the head held up or with the head held down, with its axis substantially vertical. The abovementioned clack valve comes into play to close the outlet of the valve if the axis of the container is too far away from the vertical and/or if the head of the container does not occupy the normal position.

BACKGROUND OF THE INVENTION

FR-A-2,375,111 shows a valve of this type, particularly in FIG. 5 in which the clack valve sensitive to the action of gravity comprises a ball forming a shut off member. When the container is inverted, the ball is applied against a seat and closes the passage to the stem, so that the dispensing of the compound for the aerosol is halted.

According to this prior document, the orifice intended to be closed by the ball of the clack valve has a relatively small diameter creating an additional nonnegligible drop in pressure head in normal operation.

DE-A-1,955,397 relates to a dispensing device which makes it possible to dispense a product contained in a pressurized container equipped with a dispensing head both with the head held up and with the head held down. For this purpose, the body of the valve of the dispensing head may be closed in the head held down position by a ball, and the wall of the valve body is equipped with an opening, which opening is never closed.

OBJECTS OF THE INVENTION

The object of the invention, above all, is to make the valve of the sort defined previously such that the presence of the clack valve sensitive to the action of gravity should not introduce a substantial additional drop in pressure head for the outflow of the fluid in normal operation.

The object of the invention is also to provide a valve in which the clack valve reacts to an incorrect position given to the container. This is particularly beneficial in the case of containers pressurized with the aid of compressed gas, particularly compressed air, which it is appropriate to save to prevent too frequent inflations of the container; indeed, when an incorrect position is given to the container, atomization is not satisfactory and there is a significant loss of the propellent gas.

It is also suitable for the return of the clack valve to the open position to be reliable, when the container returns from an incorrect position to a correct position.

It is furthermore desirable for such a valve to be of a modest cost price by comparison with a conventional valve.

SUMMARY OF THE INVENTION

According to the invention, a valve for a pressurized container or aerosol can, of the sort defined previously, is characterized in that the orifice is a micro-orifice which is closed when the stem is driven in in order to prevent any passage of fluid from the container into the valve body and which is opened when the stem is not driven in in order to establish a communication between the pressurized internal volume of the container and the zone of the valve situated downstream of the shut off member of the clack valve in the closed position, in order to balance out the pressures on either side of this shut off member and to facilitate its return to the open position under the action of gravity.

It is thus possible, on the one hand, to give the orifice, intended to be closed by the shut off member a relatively large diameter without the risk of the shut off member being prevented from returning to its open position as a consequence of the force due to the pressure differences which appear on either side of this shut off member when it assumes the closed position. The mass of this shut off member may be decreased, which reduces the inertia upon closure.

The force corresponding to the product of the cross section of the seat of the clack valve, times the internal pressure of the container may be greater than the weight of the shut off member, this force being counterbalanced by an opposite force obtained by virtue of the micro-leakage created by the micro-orifice.

When the valve is associated with a dip tube extending from the valve body down to the bottom of the container, which container is intended to be used with the head held up, the shut off member may be located in the dip tube which is axially closed at its lower end and equipped with at least one inlet offset radially with respect to the axis of the tube, the seat of the shut off member, particularly consisting of a ball, being provided at the end of the valve tailpiece on which the dip tube is engaged.

In order to provide quicker shut off, the shut off member may be located in a lower appendage of the valve body. The dip tube may emerge laterally into this appendange, the seat of the shut off member being situated at a small distance from the bottom of this appendage.

In the case of a valve for a container intended to be used with the head held down, the valve includes, on its body a lateral extension with a gas inlet at the top and a seat at the bottom, it being possible for the shut off member to move in this lateral extension.

The micro-orifice is advantageously produced in the form of a scallop of small dimensions provided on one edge of the valve body intended to come to bear against a sealing washer urged by the valve stem.

The valve may include a micro-orifice for the passage of gas, provided in the valve body, and a cover piece the concavity of which points in the opposite direction from the valve body, capable of moving in terms of sliding in this valve body, which cover piece constitutes the valve stem and towards its bottom this cover piece including at least one passage hole and, on its periphery, two circular sealing rings which are spaced axially and located such that in normal operation with the cover piece driven in, the passage micro-orifice is trapped between the two rings whereas in the normal position, with the valve in the closed position, the abovementioned micro-orifice establishes a passage between the inside of the valve body and the container.

Preferably, the shut off member, particularly a ball, is retained in a housing provided in the valve tailpiece.

The invention also relates to a pressurized container, or aerosol can, equipped with a valve as defined previously.

The invention consists, apart from the arrangements explained hereinabove, of a certain number of other arrangements which will be dealt with more explicitly hereafter with regard to particular embodiment examples described with reference to the appended drawings, but which are in no way limiting.

DETAILED DESCRIPTION OF THE INVENTION

Figure 1:
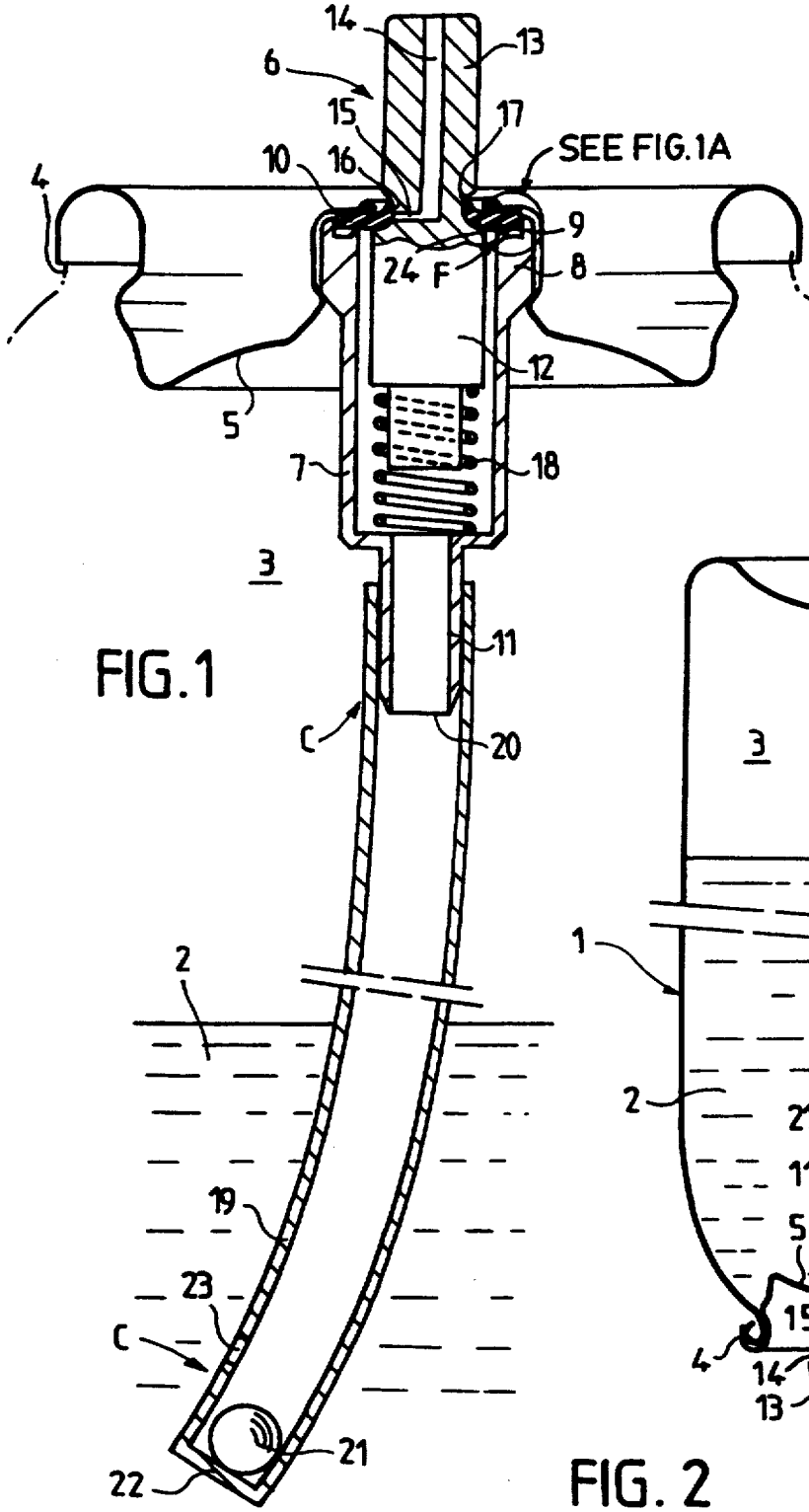
FIG. 1, of these drawings, represents, diagrammatically in section, a pressurized container and a valve with dip tube in accordance with the invention, one detail being shown on a larger scale in FIG. 1A.
Figure 1A:
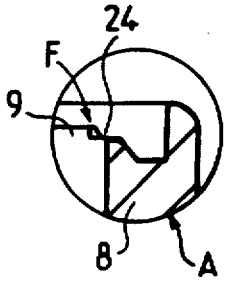
Figure 2:
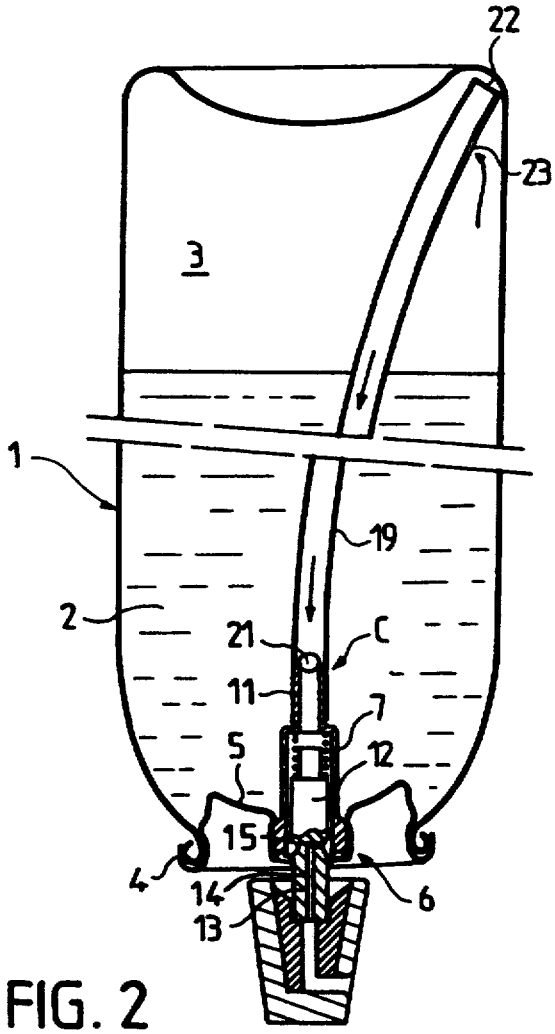
FIG. 2 shows, on a smaller scale, the container of FIG. 1 with the head held down, that is to say in an incorrect position, its operation being rendered impossible.

Referring to FIGS. 1 and 2 of the drawings, a pressurized container can be seen of the aerosol can 1 type containing a liquid 2 to be sprayed and a propellent agent 3 preferably consisting of an inert gas, particularly compressed air, or even a propellant or a mixture of liquefied gases.

The can 1 includes an opening 4 onto which is crimped a dished part 5. A dispensing valve 6 is fixed, generally by crimping, to the center of the dished part 5. The valve 6 comprises a valve body 7 equipped, at its end fixed to the dished part, with a peripheral bulge 8 or valve shell. The edge of this bulge 8, distant from the bottom of the container 1, is equipped with a peripheral rib 9 with triangular transverse section, determining a ridge against which a sealing washer 10, for example made of an elastomeric material, bears. The crimping of the central part of the dished part 5 to the bulge 8 keeps the outer edge of the washer 10 clamped against the ridge of the rib 9 in order to produce sealing at this level. However, a communication remains between the inside of the container i and the annular zone lying between the cylindrical outer surface of the bulge 1 and the internal surface of the adjoining zone of the dished part 5.

At its opposite end from the rib 9, the valve body 7 is extended by a connection piece 11 of smaller diameter, forming the valve tailpiece.

A valve stem 12 is mounted so that it can move axially in the body 7, this stem being extended by a part 13 of smaller diameter projecting to the outside. An axial passageway 14 is provided in the part 13 and opens out at the free frontal end. This passageway 14 communicates at its other end with a radial passageway 15 emerging laterally into a peripheral groove 16 provided at the junction of the extension 13 and of the part of larger diameter of the stem 12 situated in the body 7.

The border 17 of the central hole of the washer 10 has a diameter slightly smaller than the diameter of the groove 16 and clamps onto the bottom of the groove thereby forming, when the stem 12 is not driven in, a sort of outwardly curving lip in order to provide leaktight closure of the inlet of the passageway 15 with regard to the internal volume of the body 7.

The stem 12 is held in the rest or closed position represented in FIG. 1 by a return spring 18 provided between a shoulder on the body 7 and the stem 12. Enough radial space is provided between the external surface of the stem 12 and the internal surface of the body 11 to allow free passage of the fluids.

The user can cause the valve 6 to open by acting on a pushbutton (not represented), equipped with a spray nozzle communicating with the passageway 14, so as to drive the stem 12 in counter to the force of the spring 18. This action makes it possible to place the radial passageway 15 in communication with the internal volume of the body 7, the sealing washer 10 deforming at its inside edge to allow this communication whilst maintaining sealing around the base of the extension 13, with respect to the outside.

The can 1 represented in FIG. 1 is intended to be used with the head held up and a dip tube 19 is engaged around the connection piece 11, this tube extending to the bottom of the can.

The valve 12 is combined with a clack valve C sensitive to the action of gravity and capable of closing the outlet of the valve when the container 1 occupies, as illustrated in FIG. 2, a position with the head held down, which is not the normal position of use.

The clack valve C comprises a seat 20 consisting of the end of the connection piece 11 distant from the body 7, and a shut off member consisting of a ball 21 which can move under the action of gravity and is capable of being applied in leaktight fashion against the seat 20 so as to close the connection piece 11 and prevent any outlet of the product through the valve stem 12.

According to the embodiment of FIGS. 1 and 2, the ball 21 is located in the dip tube 19 which is closed axially at its lower end by a bottom 22. The tube 19 is equipped with a lateral inlet 23 provided close to the bottom 22.

In the example of FIG. 1, the inlet 23 is provided in the cylindrical wall. As a variant, one or more inlets 23, for example consisting of holes, could be provided in the bottom 22, being radially offset with respect to the axis of the tube 19.

A micro-orifice F is provided in the wall of the valve body 7 in order to establish a communication between the pressurized internal volume of the container 1 and the zone of the valve situated downstream of the ball 21 in the closed position. This micro-orifice is closed by the washer 10 when the valve stem 12 is driven in.

As is visible in detail A of FIG. 1, the micro-orifice F consists of a scallop 24 of small dimension, particularly from the point of view of angular extent, provided in the ridge of the peripheral rib 9. When the valve 12 occupies the rest or closure position represented in FIG. 1, the mean plane of the washer 10 is substantially orthogonal to the axis of the valve so that a micro-leakage is created by the scallop 24 below the washer 10 between the internal volume of the container 1 and the internal volume of the valve body 7. In contrast, when the stem 12 is driven in, the washer 10 is deformed, its internal edge being pushed back towards the bottom of the body 7, whereas its external edge is held by the crimping; the internal face of the washer 10 then assumes a concave shape and shuts off the scallop 24, so as to cut off the micro-leakage when the stem 12 is driven in and therefore when the valve 6 is open.

This being the case, the operation of the aerosol can 1 of FIG. 1 is as follows.

When this can is held in the normal position, with the head held up with its axis substantially vertical, the user may, by pressing on the pushbutton, not represented, drive the valve stem 12 in and bring about the atomization of the liquid 2. The ball 21 remains against the bottom 22 of the tube 19.

If the can 1 is overturned to the head held down position, the ball 21 is applied against the seat 20. If the user drives the stem 12 in, the internal space of the body 7 is placed in communication with the atmosphere via the passageways 15 and 14. The ball 21 is applied firmly by the pressure prevailing in the can 1 against the seat 20 and opposes any outlet of fluid via the passageways 15 and 14. Furthermore, the micro-orifice formed by the scallop 24 is closed when the stem 12 is driven in such that there is no passage of fluid from the container 1 to the inside of the body 7 via this micro-orifice.

When the valve 12 is released to return to its closed position, the scallop 24 opens again and allows pressurized gas to enter the inside of the body 7 so as to balance out the pressures on either side of the ball 21 bearing against the seat 20.

If the can 1 is inverted so as to be held head up again, the ball 21 leaves its seat 20 to move towards the bottom 22 under the action of gravity. This motion is not prevented by a pressure difference between the inside of the can 1 and the inside of the body 7, by virtue of the communication established by the scallop 24. The seat 20 may have a large diameter relative to the diameter of the ball 21 as illustrated in FIG. 1 of the drawings, which does not prevent the ball 21 from returning to the open position as soon as the can 1 is held head up again with the valve 6 closed.

Figure 3:
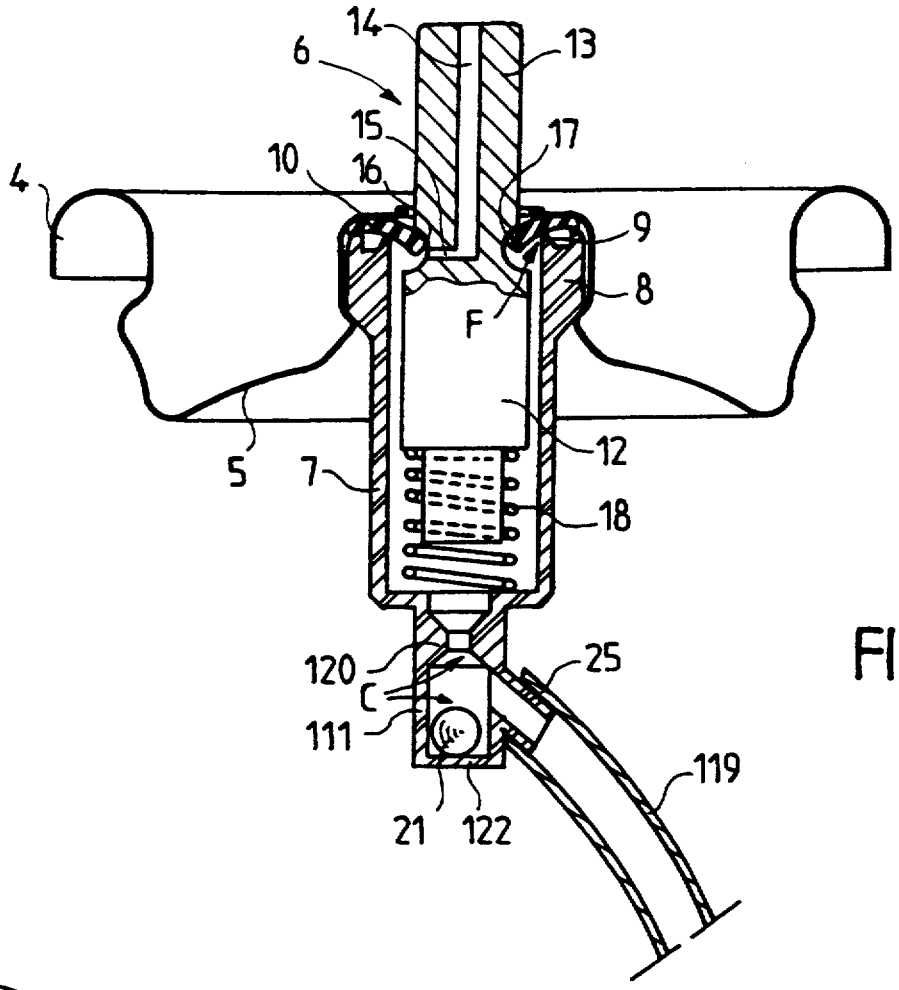
FIG. 3 illustrates an embodiment variant of the valve with a quick shut off system.

FIG. 3 illustrates an embodiment variant of the container of FIG. 1 according to which the ball 21 of the clack valve C is situated in axial proximity to its seat 120 so that the closure of the clack valve is quicker than in the case of FIG. 1 because the path which the ball 21 has to cover is shorter.

The elements of the variant of FIG. 3 which are identical to or which fulfill roles which are similar to elements already described with regard to FIG. 1 are denoted by the same numerical references or, possibly, by a numerical reference which is equal to the sum of the number 100 and of the reference used in FIG. 1. The description of these elements is not repeated or is given only briefly.

The connection piece 111 in FIG. 3 is closed by a bottom 122 against which the ball 21 rests when the can is in its normal position. The seat 120 consists of a frustoconical shoulder provided axially in the vicinity of the connection of the connection piece 111 and of the body 7. The dip tube 119 is connected to a lateral oblique faucet pipe 25 emerging into the connection piece 111 upstream of the seat 120 such that when the ball 21 is in leaktight bearing against the seat 120 the tube 119 no longer communicates with the internal volume of the body 7.

The normal position of use of the container of FIG. 3 is also head held up. The operation is similar to that of FIG. 1, but shut off is obtained more quickly in the event of incorrect positioning of the container for atomization.

Figure 4:
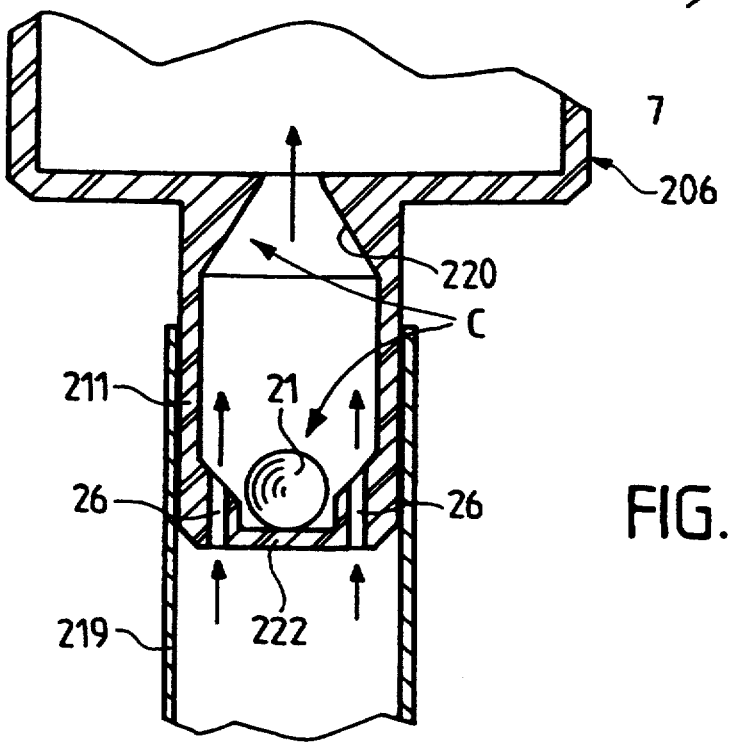
FIG. 4 is another variant of the quick shut off system.

FIG. 4 illustrates another embodiment variant of a valve according to the invention for an aerosol can which normally operates with the head held up.

As in the case of FIG. 3, the connection piece 211 of small axial length is equipped with a bottom 222 against which the ball 21 rests when the container occupies its normal position. This bottom 222 is traversed by passages 26 parallel to the axis of the connection piece 211 but radially separated from this axis so that their extensions are located, in the transverse direction, beyond the contour of the ball 21 when it bears against the center of the bottom 222. These passages 26 allow the outflow of the fluid coming from the container. The dip tube axially covers over the connection piece 211. A micro-orifice, not represented in FIG. 4, is provided as in the case of FIGS. 1 and 3 on the rim of the valve body.

The operation of the container equipped with the valve of FIG. 4 is similar to that described previously. If the container is placed in an incorrect position, for example with the head held down, the ball 21 is applied against the seat 220 and prevents any communication between the inside of the container and the outlet of the valve.

When the valve is closed again, pressure equilibrium is established on either side of the ball 21 bearing on the seat 220. As soon as the container is returned to its normal position with the head held up, the ball 21 drops against the bottom 222.

Figure 5:
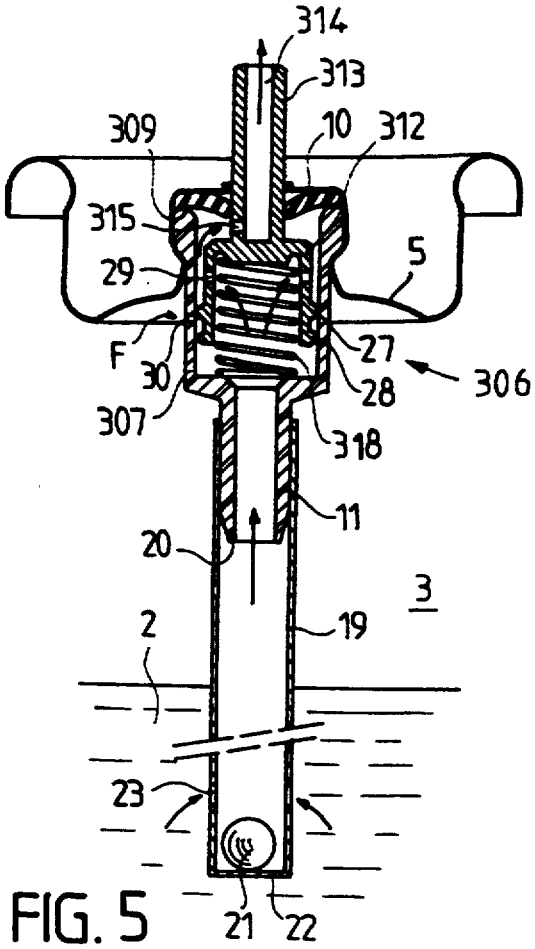
FIGS. 5 to 7 represent, respectively with the head held up, the head held down, and return to the head held up position, a valve in accordance with another embodiment variant.
Figure 6:
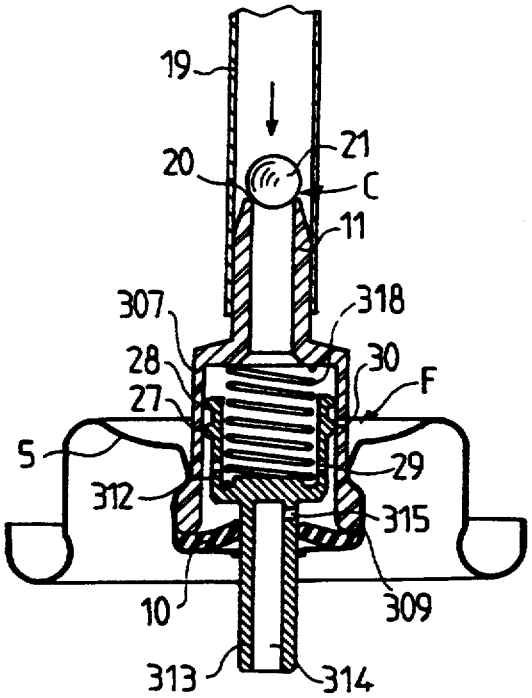
Figure 7:
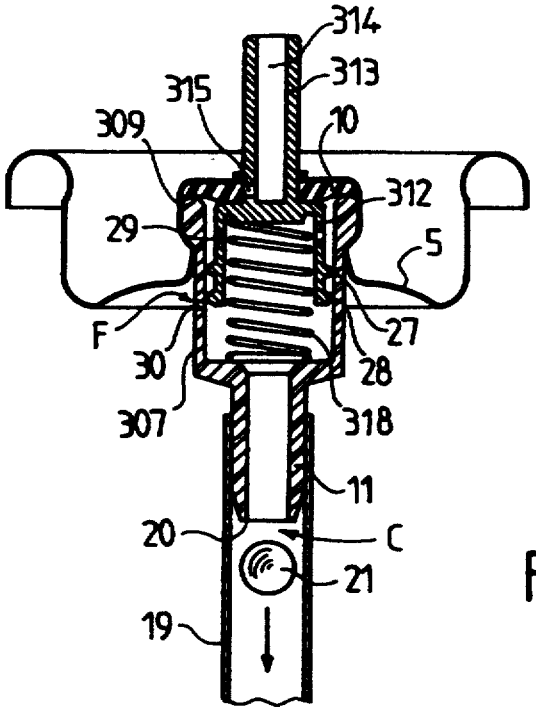

FIGS. 5 to 7 illustrate another embodiment variant of a valve in accordance with the invention for a container intended to be used with the head held up.

The elements of FIGS. 5 to 7 which are identical to or similar to elements already described with regard to FIG. 1 are denoted either by the same numerical references, or by a numerical reference equal to the sum of the number 300 and of the reference used in FIG. 1. The description of these elements will not be repeated or will be given only briefly.

The valve 306 comprises, instead of a valve stem, a cover piece 312 the concavity of which points in the opposite direction from the valve body 307. The extension 313 of smaller diameter, projecting towards the outside, is secured to the bottom of the cover piece 312 and coaxial with the latter. This extension 313 includes an axial passageway 314 which, in the vicinity of the bottom of the cover piece 312, communicates with a radial hole 315 passing through the wall of the extension 313.

When the valve 306 is at rest, this passage 315 is closed by the washer 10.

The return spring 318 is engaged in the cover piece 312 and compressed between the bottom of this cover piece and the shoulder of the body 307.

The cover piece 312 includes, on its cylindrical external surface, two circular rings 27, 28 spaced axially and situated towards the end of the cover piece distant from the extension 313. These rings 27, 28 are provided to slide in leaktight fashion against the internal surface of the body 307.

The wall of the cover piece 312 is traversed radially, in the vicinity of its bottom, that is to say in the vicinity of the base of the extension 313, by holes 29 evenly distributed over the entire periphery.

A micro-orifice F, consisting of a hole 30 of small diameter is provided in the wall of the valve body 307 at a location such that when the cover piece 312 occupies the rest position (see FIG. 7), this hole 29 places the inside of the valve body 307 and of the cover piece 312 in communication with the container 1, the sealing ring 28 being located, in the axial direction, on the opposite side of the hole 30 from the connection piece 11. In contrast, when the extension 313 is driven in with the cover piece 312, as represented in FIG. 5, in order to open the valve, the hole 30 emerges in the closed annular space lying between the two sealing rings 27, 28.

This being the case, the operation of the valve of FIGS. 5 to 7 results immediately from the foregoing explanations.

When the container occupies its normal position with the head held up, as illustrated in FIG. 5, the driving in of the extension 313 and of the cover piece 312 opens the passage 315 which places the inside of the valve body 307 in communication with the passageway 314 and the outside.

The liquid and gaseous fluids can flow out through the passages 29 coming from the container 1 towards the passageway 314 and atomization is obtained. The sealing rings 27 and 28 prevent leakage towards the outside through the hole 30.

If the container is used in an incorrect position, for example in the head held down position, as illustrated in FIG. 6, the ball 21 is applied to the seat 20 and cuts off any communication between the container 1 and the axial outlet passageway 314. The internal volume of the valve body 307 is at atmospheric pressure owing to the communication established by the passage 315 when the valve is in the open position, the cover piece 312 being driven in. The sealing rings 27 and 28 oppose the intake of fluid, particularly of liquid, at the pressure of the container 1 into the valve body 307 through the hole 30 for as long as the valve cover piece is driven in, that is to say for as long as the valve 306 is held open.

When this valve 306 returns to its closed position, as illustrated in FIG. 7, the hole 30 establishes a communication between the inside of the container 1 and the inside of the valve body 307, which reestablishes pressure equilibrium on either side of the ball 21.

When the can 1 is returned to its normal position, with the head held up, the ball 21, owing to the reestablished pressure equilibrium, can return by means of gravity to the position of FIG. 5, leaving the seat 20, which again allows communication between the container 1 and the inside of the valve body 307.

Figure 8:
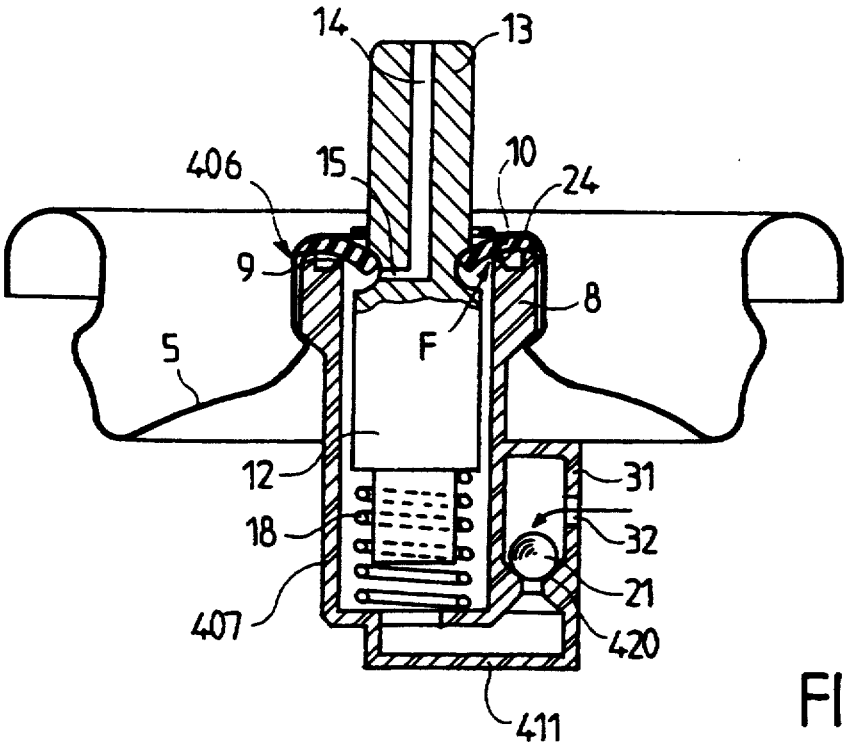
FIG. 8 illustrates a valve according to the invention intended for operation with the head held down, and which is in the blockage position according to this FIG. 8.
Figure 9:
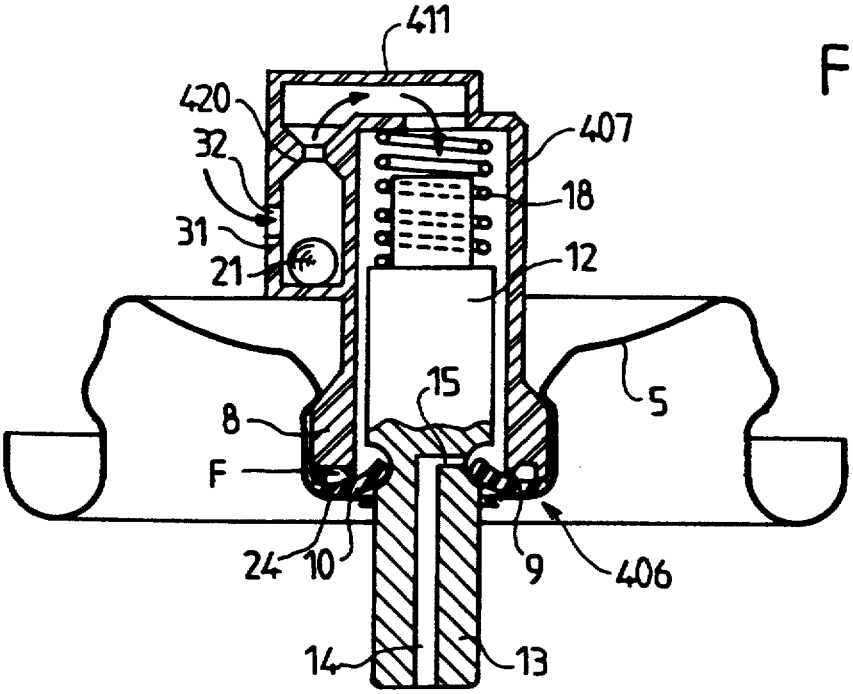
FIG. 9, finally, illustrates the valve of FIG. 8 in its normal operating position with the head held down.

FIGS. 8 and 9 illustrate a valve variant in accordance with the invention for a container intended to be used with the head held down.

The valve 406 includes, on its body 407, a lateral extension 31 extending parallel to the axis of the body 407 between the bottom of this body and a zone situated closer to the dished part 5. The extension 31 communicates, at its end distant from the dished part, with the bottom of the body 407 via a connection piece 411 pointing radially. The ball 21 is located in the lateral extension 31. A seat 420 for this ball is provided in the vicinity of the connection of the extension 31 and of the connection piece 411, that is to say at the bottom of the extension 31 when the container is held head up as represented in FIG. 8. A gas inlet 32 is provided in the wall of the extension 31 on the same side as the dished part 5 with respect to the seat 420, that is to say at the top in the position of FIG. 8. When the ball 21 bears against the seat 420 the opening 32 ensures the intake of pressurized gas on the opposite side of the ball from the seat.

The other parts of the valve of FIGS. 8 and 9 are similar to or identical to those of the valve of FIG. 1, and are denoted by the same numerical references, possibly added to the number 400. A description of them will not be repeated.

It will, however, be noticed that the micro-orifice F consists of a scallop 24 in the peripheral rib 9 of the valve body.

The operation of the valve of FIGS. 8 and 9 is as follows.

When the container is placed in its normal operating position "head held down", corresponding to the representation of FIG. 9, the ball 21 rests, by means of gravity, against the bottom of the lateral extension 31 opposite the connection piece 411. When the user drives the valve stem 12 in, the fluids can pass through the hole 32 and flow out through the seat 420 towards the outlet of the valve. Atomization may take place.

In contrast, when the container is placed in an incorrect position, particularly "head held up" as represented in FIG. 8, the ball 21 is applied to the seat 420 and closes any communication with the outlet.

If the valve stem 12 is driven in, as illustrated in FIG. 8, there is no atomization owing to the shut off created by the ball 21.

If, after having driven in the valve stem 12, whilst the container occupies an incorrect position, the user releases this valve, the inside of the valve body 407 is at atmospheric pressure so that the pressure difference between the inside of the container and the inside of the valve body 407 contributes to keeping the ball 21 against its seat.

When the valve stem 12 is released, the micro-orifice F constituted by the scallop 24 is no longer closed by the sealing washer 10, and a communication is established between the inside of the body 407 and the inside of the container, which allows the pressures to be balanced out on either side of the ball 21. The latter will then be able to resume the position of FIG. 9 as soon as the container is placed in the correct position, with the head held down, without a force created by a pressure difference having to be overcome.

Regardless of the embodiment adopted, the valve in accordance with the invention allows a saving of propellent agent by reacting quickly and by preventing any outlet of fluid when the container occupies an incorrect position. The return of the valve to the normal operating position is reliable and quick by virtue of the balancing out of pressure performed on either side of the ball 21.

I claim:

1. Valve for a pressurized container (1), comprising a valve body (7, 307, 407) having a wall and intended to be fixed into a dished part mounted on the container (1), a valve stem (12) which can move axially in the valve body (7, 307, 407), a valve outlet, and elastic return means (18) for returning the valve stem (12) to a closed position, whereas opening of the valve is obtained by a driving-in action on the stem (12), said valve being operatively associated with a clack valve (C) which is sensitive to the action of gravity and includes a shut off member (21) for obstructing fluid flow to the outlet of the valve when the container occupies a position away from a normal position of use, an orifice (F) being provided in the wall of the valve body (7, 307, 407), means for closing said orifice when the stem (12) is driven in in order to prevent any passage of fluid from the container (1) into the valve body (7, 307, 407), and said orifice being open when the stem (12) is not driven in in order to establish a communication between the pressurized internal volume of the container (1) and a zone of the valve (6, 206,306,406) situated downstream of the shut off member (21) of the clack valve (C) in a closed position, in order to balance out the pressures on either side of said shut off member (21) and to facilitate returning said shut off member to the open position under the action of gravity.

2. Valve according to claim 1, further including a dip tube, said shut off member (21) being located in said dip tube (19) which is axially closed at its lower end and equipped with a lateral inlet (23) offset radially with respect to the axis of the tube (19), and a seat (20) for the shut off member (21) being provided at the end of a valve tailpiece on which the dip tube (19) is engaged.

3. Valve according to claim 1, wherein the shut off member (21) is located in a lower appendage (111, 211) of the valve body, a seat (120, 220 for the shut off member (21) being situated at a distance from the bottom of said appendage.

4. Valve according to claim 3, further including a dip tube (119) which emerges laterally into the appendage (111).

5. Valve according to claim 1, further including on its body (407) a lateral extension (31) with a gas inlet (32) at the top thereof and a seat (420) at the bottom thereof, whereby the shut off member (21) is located in said lateral extension and is adapted to move in said lateral extension.

6. Valve according to claim 1, wherein the orifice (F) consists of a scallop (24) provided on one edge (9) of the valve body (7) intended to come to bear against a sealing washer (10) urged by the valve stem (12).

7. Valve according to claim 1, wherein the valve stem includes a concave cover piece (312) facing in a downward direction, and axially movable in said valve body, said cover piece having towards its bottom at least one passage hole (29) and, said means for closing being located on its periphery, two circular sealing rings (27, 28) which are spaced axially and located such that in normal operation with the cover piece driven in, the orifice (30) is trapped between the two rings (27, 28) whereas in a normal position, with the valve in the closed position, said orifice (30) establishes a passage between the inside of the valve body (307) and the container (1).

8. Valve according to claim 1 wherein the shut off member (21) consists of a ball.

9. Pressurized aerosol system comprising a pressurized container and a valve; said valve having a valve body, a wall and being fixed into a dished part mounted on the container, a valve stem axially movable in the valve body, a valve outlet, and elastic return means for returning the valve stem to a closed position, whereas opening of the valve is obtained by a driving-in action on the stem, said valve being operatively associated with a clack valve (C) which is sensitive to the action of gravity and includes a shut off member for obstructing fluid flow to the outlet of the valve when the container occupies a position away from a normal position of use, an orifice (F) being provided in the wall of the valve body, means for closing said orifice when the stem is driven in in order to prevent any passage of fluid from the container into the valve body and said orifice being open when the stem is not driven in in order to establish a communication between the pressurized internal volume of the container and a zone of the valve situated downstream of the shut off member of the clack valve (C) in a closed position, in order to balance out the pressures on either side of said shut off member and to facilitate returning said shut off member to an open position under the action of gravity.

* * * * *